US009039441B2

(12) United States Patent
Takamori et al.

(10) Patent No.: US 9,039,441 B2
(45) Date of Patent: May 26, 2015

(54) ELECTRICAL CONNECTION TERMINAL WITH CONTINUITY CHECK PORTIONS AND CONNECTOR USING SAME

(75) Inventors: Satoshi Takamori, Shiga (JP); Seiji Shimada, Shiga (JP); Shunsuke Akahori, Kanagawa (JP)

(73) Assignee: OMRON Corporation, Kyoto (JP)

( * ) Notice: Subject to any disclaimer, the term of this patent is extended or adjusted under 35 U.S.C. 154(b) by 480 days.

(21) Appl. No.: 13/446,175

(22) Filed: Apr. 13, 2012

(65) Prior Publication Data

US 2012/0268137 A1 Oct. 25, 2012

(30) Foreign Application Priority Data

Apr. 13, 2011 (JP) ..... 2011-089309

(51) Int. Cl.

| | |
|---|---|
| ***H01R 12/00*** | (2006.01) |
| ***H01R 12/77*** | (2011.01) |
| ***H01R 12/62*** | (2011.01) |
| ***H01R 43/00*** | (2006.01) |

(52) U.S. Cl.

CPC ..... *H01R 12/774* (2013.01); *H01R 12/62* (2013.01); *H01R 43/00* (2013.01); *Y10S 439/912* (2013.01)

(58) Field of Classification Search

CPC ..... H01R 2201/20
USPC ..... 439/260, 495, 912
See application file for complete search history.

(56) References Cited

U.S. PATENT DOCUMENTS

| | | | | |
|---|---|---|---|---|
| 2,732,446 A * | 1/1956 | Gilmore | ..... | 200/51.1 |
| 2,795,664 A * | 6/1957 | Conrad | ..... | 200/51.1 |
| 3,206,707 A * | 9/1965 | Lo Vetere | ..... | 439/505 |
| 3,234,433 A * | 2/1966 | Braunagel | ..... | 361/746 |
| 3,366,919 A * | 1/1968 | Gammel, Sr. et al. | ..... | 439/495 |
| 3,568,136 A * | 3/1971 | Wells | ..... | 439/638 |
| 3,656,183 A * | 4/1972 | Walterscheid | ..... | 439/73 |
| 3,718,859 A * | 2/1973 | Arlow | ..... | 324/72.5 |

(Continued)

FOREIGN PATENT DOCUMENTS

| | | |
|---|---|---|
| CN | 101872910 A | 10/2010 |
| CN | 201789111 U | 4/2011 |

(Continued)

OTHER PUBLICATIONS

Taiwan First Office Action dated Mar. 26, 2014 from corresponding TW Application No. 101110777, 13 pages.

(Continued)

*Primary Examiner* — Neil Abrams
(74) *Attorney, Agent, or Firm* — Klarquist Sparkman, LLP

(57) ABSTRACT

An electrical connection terminal capable of reducing manufacturing cost of a connector and a probe, and preventing erroneous contact between the connection terminal and a continuity check pin at the time of a continuity check, and a connector using the same. The connection terminal includes a fixed piece to be fixed to a base of the connector, a coupling portion extending upward from the fixed piece, and a movable piece extending from the coupling portion in the direction facing the fixed piece. The connection terminal arranged side by side in the base further includes an extending portion for the continuity check provided in an end of the fixed piece, and a projection for the continuity check provided at an upper side of the movable piece or the coupling portion. The continuity check may be provided by use of the probe with two rows of check pins.

7 Claims, 11 Drawing Sheets

(56) References Cited

U.S. PATENT DOCUMENTS

| | | | | | |
|---|---|---|---|---|---|
| 3,825,878 | A * | 7/1974 | Finger et al. | 439/493 |
| 3,855,567 | A * | 12/1974 | Harms et al. | 439/593 |
| 3,874,768 | A * | 4/1975 | Cutchaw | 439/72 |
| 3,941,448 | A * | 3/1976 | Evans | 439/493 |
| 3,993,384 | A * | 11/1976 | Dennis et al. | 439/71 |
| 4,023,879 | A * | 5/1977 | Braund et al. | 439/76.1 |
| 4,030,799 | A * | 6/1977 | Venaleck | 439/405 |
| 4,145,103 | A * | 3/1979 | Knowles | 439/400 |
| 4,168,877 | A * | 9/1979 | Little et al. | 439/347 |
| 4,175,811 | A * | 11/1979 | Coldren et al. | 439/507 |
| 4,245,274 | A * | 1/1981 | MacDonald et al. | 313/519 |
| 4,270,826 | A * | 6/1981 | Narozny | 439/260 |
| 4,341,433 | A * | 7/1982 | Cherian et al. | 439/525 |
| 4,342,495 | A * | 8/1982 | Bennett et al. | 439/689 |
| 4,358,173 | A * | 11/1982 | Conrad | 439/71 |
| 4,556,275 | A * | 12/1985 | Hamsher, Jr. | 439/736 |
| 4,637,965 | A * | 1/1987 | Davis | 429/1 |
| 4,690,475 | A * | 9/1987 | McElroy | 439/502 |
| 4,802,867 | A * | 2/1989 | Palmer | 439/587 |
| 4,810,208 | A * | 3/1989 | Hayes et al. | 439/589 |
| 4,815,988 | A * | 3/1989 | Scherer | 439/392 |
| 4,932,898 | A * | 6/1990 | Goodman et al. | 439/582 |
| 4,947,115 | A * | 8/1990 | Siemon et al. | 324/755.05 |
| 4,995,829 | A * | 2/1991 | Geib et al. | 439/409 |
| 5,226,824 | A * | 7/1993 | Karlovich et al. | 439/70 |
| 5,260,994 | A * | 11/1993 | Suffi | 379/413.04 |
| 5,316,496 | A * | 5/1994 | Imai | 439/495 |
| 5,733,153 | A * | 3/1998 | Takahashi et al. | 439/801 |
| 5,975,944 | A * | 11/1999 | Medina et al. | 439/493 |
| 6,074,242 | A * | 6/2000 | Stefaniu et al. | 439/441 |
| 6,124,716 | A * | 9/2000 | Kanamori | 324/538 |
| 6,188,560 | B1 * | 2/2001 | Waas | 361/119 |
| 6,280,236 | B1 * | 8/2001 | Daoud | 439/482 |
| 6,293,815 | B1 * | 9/2001 | Daoud | 439/426 |
| 6,338,648 | B1 * | 1/2002 | Miura et al. | 439/495 |
| 6,540,527 | B1 * | 4/2003 | Tamarkin | 439/67 |
| 6,814,627 | B2 * | 11/2004 | Yamamoto et al. | 439/701 |
| 7,140,899 | B2 * | 11/2006 | Matsunaga | 439/326 |
| 7,714,569 | B2 * | 5/2010 | Li et al. | 324/756.05 |
| 7,906,957 | B2 * | 3/2011 | Tarchinski et al. | 324/149 |
| 8,105,102 | B2 * | 1/2012 | Sunaga | 439/260 |
| 2014/0253146 | A1 * | 9/2014 | Kesler | 324/555 |

FOREIGN PATENT DOCUMENTS

| | | | |
|---|---|---|---|
| FR | 2467491 | * | 4/1981 |
| GB | 1094473 | * | 12/1967 |
| JP | 1-298665 | * | 12/1989 |
| JP | 05-057763 | | 7/1993 |
| JP | 5-57763 | | 7/1993 |
| JP | 11-312561 | | 11/1999 |
| JP | 2002-270290 | | 9/2002 |
| TW | 2010-29278 A | | 8/2010 |

OTHER PUBLICATIONS

Chinese First Office Action from corresponding CN Application No. 2012101101316, 8 pages.

Japanese Office Action dated May 27, 2014 corresponding to Japanese Patent App. No. 2011-089309, 15 pp.

Taiwan First Office Action dated Mar. 26 2014 from corresponding TW Application No. 101110777, 13 pp.

Chinese First Office Action from corresponding CN Application No. 2012101101316, 14 pp.

* cited by examiner

ELECTRICAL CONNECTION TERMINAL WITH CONTINUITY CHECK PORTIONS AND CONNECTOR USING SAME

BACKGROUND OF THE INVENTION

1. Technical Field

The present invention relates to a connector connection terminal, and in particular, to a connector connection terminal for connecting a flexible print substrate.

2. Related Art

Conventionally, in order to perform a continuity check for connection terminals press fitted inside a housing, a connection terminal provided with a continuity check portion and a connector using the same are proposed. In particular, in this connector, a continuity state between the connection terminals and an exterior substrate on which the connection terminals are mounted is checked without inserting a flexible print substrate.

For example, Japanese Unexamined Utility Model Publication No. 05-057763 describes a connector in which one continuity check portion provided in an upper arm of a connection terminal protrudes from an upper surface of a housing via a receiving portion. In this connector, a continuity check probe is directly pressed onto and brought into contact with the continuity check portion to perform a continuity check.

However, in the connector described in Japanese Unexamined Utility Model Publication No. 05-057763, only one continuity check portion is provided in the connection terminal. Therefore, when the connection terminals are arranged side by side in the housing at 0.5 mm pitch for example, there is a need for providing needle shape continuity check pins respectively corresponding to the individual connection terminals at 0.5 mm pitch. As a result, there is a need for precise assembling processing, and there is a problem that manufacturing cost of the continuity check probe serving as a tool for performing the continuity check is increased, and the continuity check pins are brought into erroneous contact with the adjacent connection terminals at the time of the continuity check.

SUMMARY

The present invention is achieved in consideration with the above conventional problem, and an object thereof is to provide a connector connection terminal capable of easily manufacturing a connector and a continuity check probe, and preventing erroneous contact between continuity check pins and adjacent connection terminals at the time of a continuity check, and a connector using the same.

In order to achieve the above object, in accordance with one aspect of the present invention, a connector connection terminal includes a fixed piece to be fixed to a base of a connector, a coupling portion extending upward from the fixed piece, and a movable piece extending from the coupling portion in the direction facing the fixed piece, and the connector connection terminal arranged side by side in the base further includes an extending portion provided in an end of the fixed piece, and a projection provided at an upper side of the movable piece or the coupling portion.

According to the above configuration, the continuity check can be performed by at least one of two points of the extending portion for the continuity check and the projection for the continuity check. Thereby, there is no need for manufacturing two types of connection terminals corresponding to places in which the continuity check is performed. Thus, cost of a die required for manufacturing the connection terminals can be reduced.

The projection may extend on the same straight line as the coupling portion.

By providing the extending portion for the continuity check in the end of the fixed piece and providing the projection for the continuity check on the same straight line as the coupling portion having high support strength, even when a load is applied at the time of the continuity check, deformation and breakage of the connection terminal can be prevented.

The movable piece may extend to both sides from a free end of the coupling portion, and the projection may be provided in the movable piece or the coupling portion.

Thereby, the continuity check can also be performed from the upper side of the base.

The plurality of connector connection terminals may be incorporated in a base and arranged side by side, and first receiving portions from which the extending portions are exposed, and second receiving portions from which the projections are exposed may be arranged in a zigzag manner in the base.

According to the above configuration, the continuity check pins are abutted with the projections for the continuity check and the extending portions for the continuity check via the first receiving portions and the second receiving portions arranged in a zigzag manner. Thus, the continuity check pins can be arranged in a zigzag manner, so that an interval between the adjacent continuity check pins can be extended. Therefore, at the time of the continuity check, erroneous contact between the connection terminals and the continuity check pins can be prevented. There is no need for precise assembling processing, and the continuity check probe is easily manufactured. Thus, manufacturing cost can be reduced. Further, a continuity state between the connection terminals and an exterior substrate can be checked without inserting a flexible print substrate into the base.

The first receiving portions may be provided in a lower portion of the base, and the second receiving portions may be provided in an upper portion of the base, respectively. Thereby, a height position is different between the first receiving portions and the second receiving portions. Therefore, length is different between first continuity check pins conducted to the extending portions for the continuity check via the first receiving portions and second continuity check pins conducted to the projections for the continuity check via the second receiving portions. As a result, the first continuity check pins are easily positioned in the first receiving portions, and the second continuity check pins are easily positioned in the second receiving portions.

Ends of the first and second receiving portions may have a surface shape capable of being fitted to distal ends of continuity check pins to be abutted with the extending portions or the projections.

Thereby, positioning precision is improved, so that displacement of the continuity check pins can be prevented.

The movable pieces may be operated and turned by an operation lever turnably assembled to the base, so as to nip flat conductive wire inserted between the movable pieces and the fixed pieces.

Thereby, even in the connector using the operation lever, by using the connection terminals of the present invention, there is an effect of easily manufacturing the continuity check probe, and preventing erroneous contact between the connection terminals and the continuity check pins at the time of the continuity check.

In a connector continuity check method, a connector connection terminal has a fixed piece to be fixed to a base of a connector, a coupling portion extending upward from the fixed piece, and a movable piece extending from a free end of the coupling portion in the direction facing the fixed piece, the connector connection terminal further includes an extending portion provided in an end of the fixed piece, and a projection provided at an upper side of the movable piece or the coupling portion, first receiving portions from which the extending portions are exposed, and second receiving portions from which the projections are exposed are arranged in a zigzag manner in the base in which the plurality of connector connection terminals is incorporated and arranged side by side, and the continuity check method performs a continuity check by fitting first continuity check pins for performing the continuity check to ends of the first receiving portions and abutting the first continuity check pins with the extending portions, and fitting second continuity check pins for performing the continuity check to ends of the second receiving portions and abutting the second continuity check pins with the projections.

By the above method, the positioning precision of the continuity check pins is improved, so that the displacement can be prevented. Therefore, working efficiency of the continuity check can be improved.

The first continuity check pins are abutted with the extending portions provided in the ends of the fixed pieces, and the second continuity check pins are abutted with the projections provided at the upper sides of the movable pieces or the coupling portion. Thus, even when a load is applied at the time of the continuity check, the deformation and the breakage of the connection terminals can be prevented.

The continuity check pins are abutted with the projections for the continuity check and the extending portions for the continuity check via the first receiving portions and the second receiving portions arranged in a zigzag manner. Thus, the continuity check pins can be arranged in a zigzag manner, so that the interval between the adjacent continuity check pins can be extended. Therefore, at the time of the continuity check, erroneous contact between the connection terminals and the continuity check pins can be prevented. There is no need for precise assembling processing, and the continuity check probe is easily manufactured. Thus, the manufacturing cost can be reduced. Further, the continuity state between the connection terminals and the exterior substrate can be checked without inserting a flexible print substrate into the base.

DETAILED DESCRIPTION

Figure 1A:
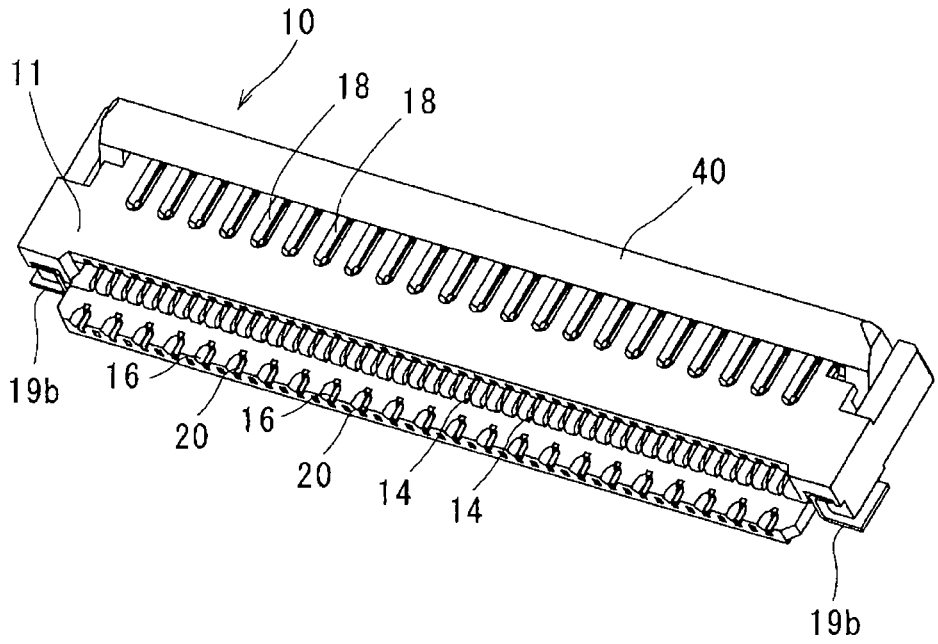
FIGS. 1A and 1B are perspective views showing a connector in which connector connection terminals according to the present invention are incorporated, the views being seen from different angles.
Figure 1B:
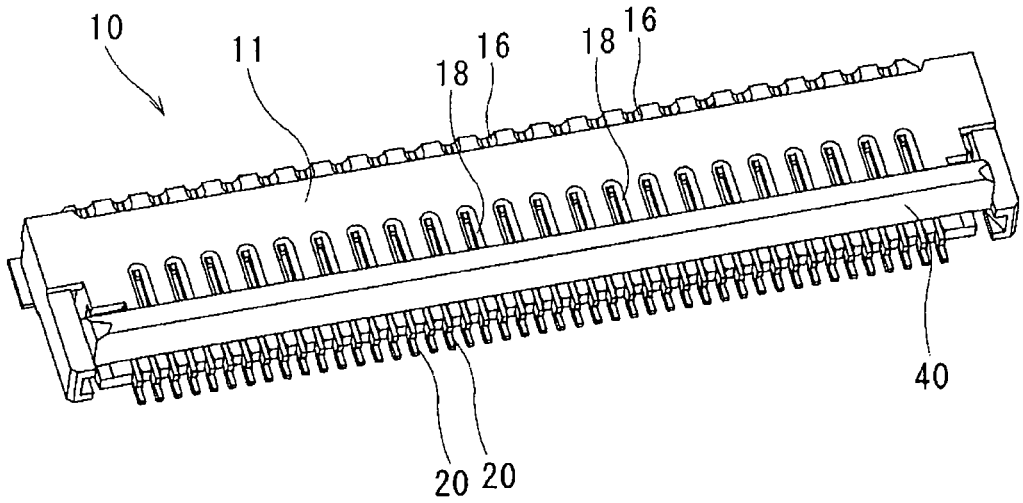

An embodiment according to the present invention will be described with reference to FIG. 1A to FIG. 10B.

As shown in FIGS. 1A to 3, a connector 10 according to the present embodiment broadly includes a base 11, connection terminals 20, and an operation lever 40. It should be noted that for convenience of description, in FIG. 1A, the near side is referred to as the front surface side of the connector 10, and the far side is referred to as the rear surface side. A flexible print substrate 50 provided with flat conductive wire is inserted into the connector 10 from the front surface side toward the rear surface side (refer to FIGS. 8A and 8B).

Figure 4A:
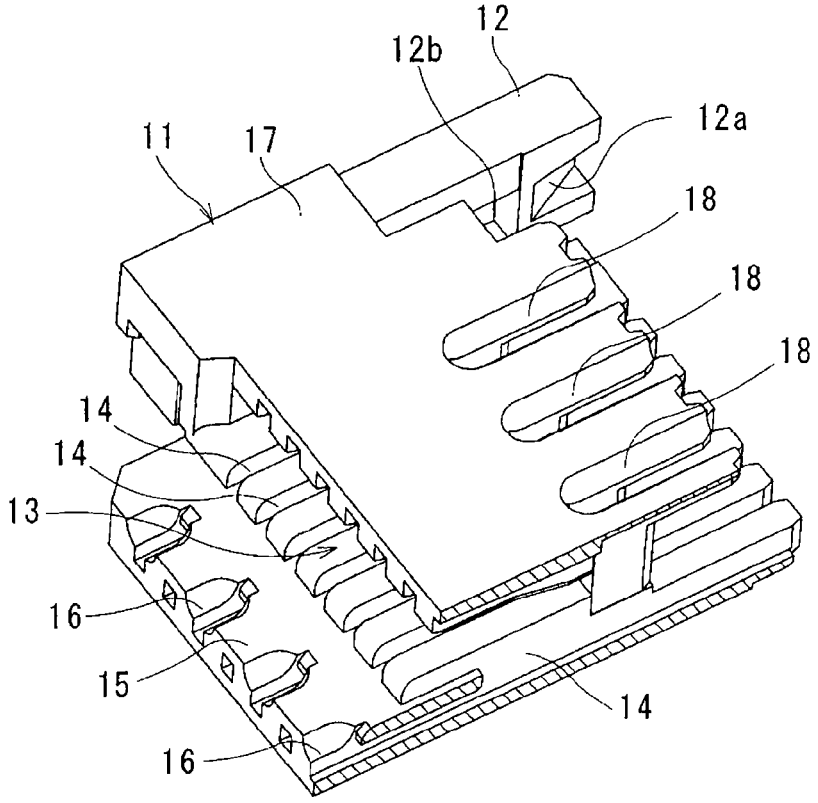
FIG. 4A is a sectional perspective view of a base shown in FIG. 2A seen from the front surface side.
Figure 4B:
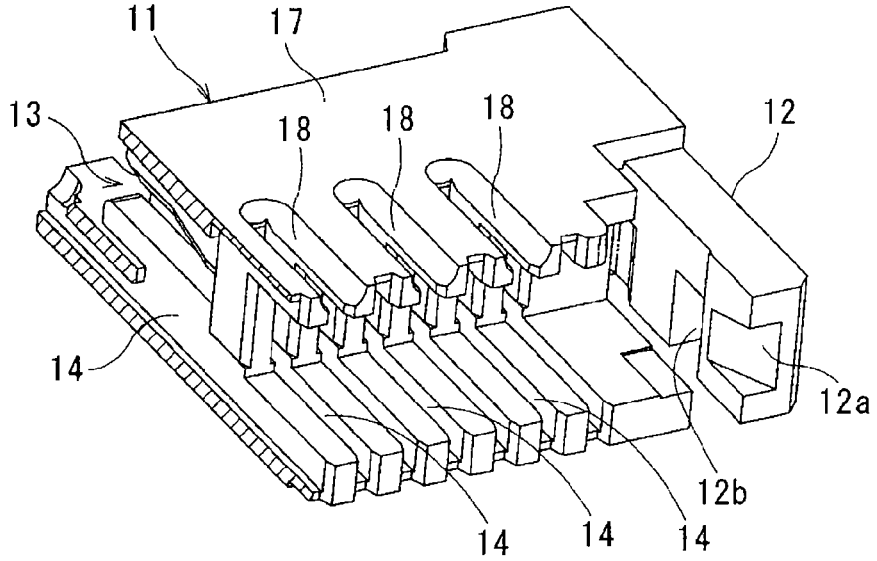
FIG. 4B is a sectional perspective view of the base of FIG. 4A seen from the rear surface side.

As shown in FIGS. 4A and 4B, elastic arms 12 are arranged in the base 11 so as to respectively extend in parallel toward the rear surface side from one side edges of both side end surfaces. In an inward surface of the elastic arm 12, a guide tapered surface 12*a* is formed at a distal end edge and a bearing recess portion 12*b* is formed on the inner side. The base 11 includes, on the front surface side, an opening 13 into which a distal end of the flexible print substrate 50, to be hereinafter described, can be inserted, where insertion holes 14 passing from the front surface through to the rear surface are arranged side by side at a predetermined pitch. In a front edge of a lower portion 15 forming the opening 13, first receiving portions 16 of curved surfaces communicating with the insertion holes 14 are provided. In a rear surface side edge of an upper portion 17, second receiving portions 18 communicating with the insertion holes 14 and extending in the same direction as the inserting direction of the connection terminals 20, to be hereinafter described, are provided. Curved surfaces are formed in front surface side ends of the second receiving portions 18. The first receiving portions 16 and the second receiving portions 18 are alternately arranged in a zigzag manner with respect to the adjacent insertion holes 14, 14.

That is, in FIG. 4A, the first receiving portions 16 are provided so as to communicate with the insertion holes 14 in odd number rows counting from the left side, and the second receiving portions 18 are provided so as to communicate with the insertion holes 14 in even number rows.

Figure 3:
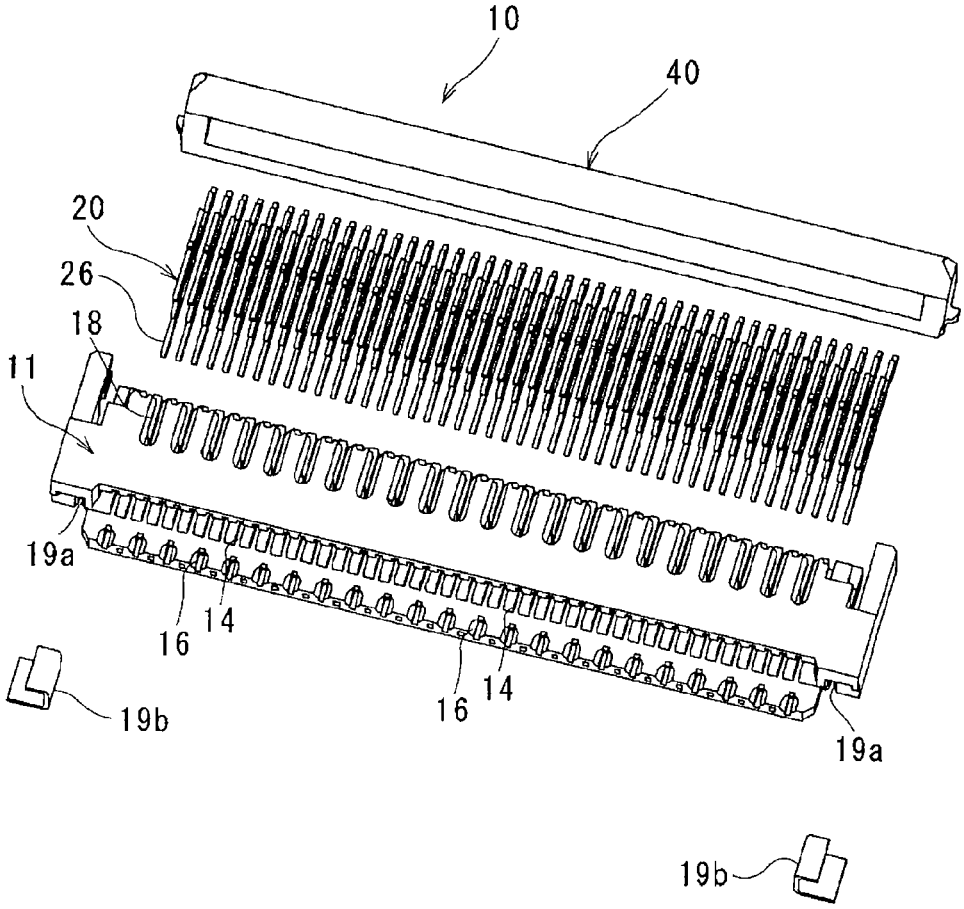
FIG. 3 is an exploded perspective view of the connector shown in FIGS. 1A and 1B.

Further, as shown in FIG. 3, cutout portions 19*a* extending toward the far side are formed in both front surface side ends of the base 11. Connection fittings 19*b* having a U shape section to be engaged are inserted into the cutout portions 19*a*, and the base 11 is fixed to an exterior substrate (not shown) via the connection fittings 19*b*.

Figure 5A:
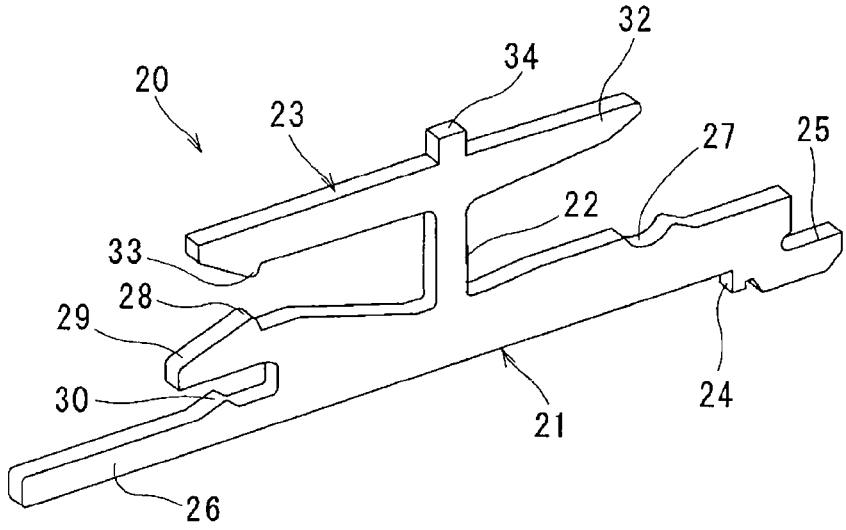
FIG. 5A is a perspective view of the connection terminal shown in FIG. 3 seen from the front surface side.
Figure 5B:
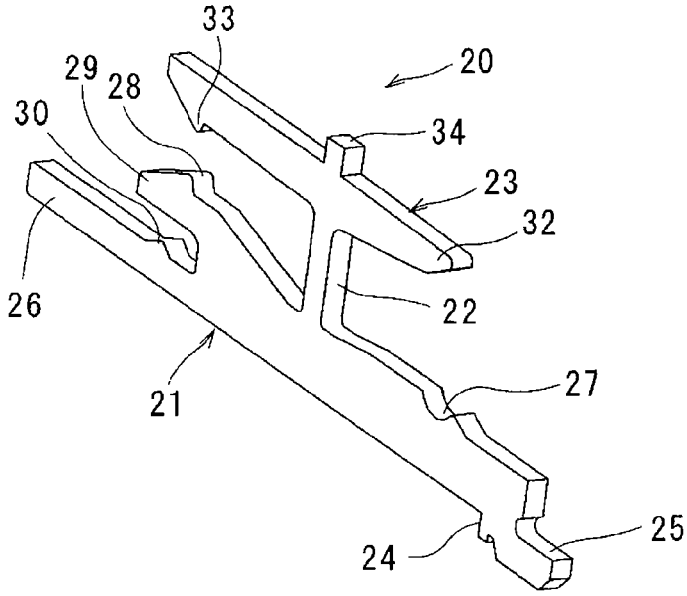
FIG. 5B is a perspective view of the connection terminal of FIG. 5A seen from the rear surface side.

As shown in FIGS. 5A and 5B, the connection terminal 20 includes a fixed piece 21 to be inserted into and fixed to the insertion hole 14 of the base 11, a coupling portion 22 arranged in a projecting manner at an upper side of the fixed piece 21, and a movable piece 23 extending in substantially parallel to the fixed piece 21 to both sides from an upper end of the coupling portion 22. The connection terminals 20 have a thickness of 0.1 mm, for example, and are arranged side by side in the base 11 at 0.5 mm intervals.

The fixed piece 21 includes a continuity check extending portion 26 extending toward the front side, and a solder connection portion 25 to be connected to the exterior substrate by soldering or the like at a lower side of a rear surface side end thereof. A fixing projection 30 projecting toward a distal end 29, to be hereinafter described, is formed at an upper side of the continuity check extending portion 26. A locking step portion 24 for locking onto an edge of the base 11 for positioning is formed on the front surface side of the solder connection portion 25. Further, at the upper side of the fixed piece 21, a lower contact 28 projecting upward is provided on the front surface side of the coupling portion 22, and a turning receiving portion 27 recessed downward is provided on the rear surface side of the coupling portion 22. The lower contact 28 not only prevents slipping out of the inserted flexible print substrate 50 but also functions as a contact in a case where the flexible print substrate 50 tilts toward the lower contact 28. A lower part of the lower contact 28 is cut out into a rectangular shape so as to form the distal end 29.

The coupling portion 22 couples the fixed piece 21 with the movable piece 23 and turnably supports the movable piece 23.

An operation receiving portion 32 for receiving an operation from the operation lever 40 is provided in one end of the movable piece 23. Meanwhile, a movable contact 33 projecting downward is provided in the other end. The movable contact 33 is arranged immediately above the lower contact 28. A projection 34 for the continuity check extending on the same straight line as the coupling portion 22 projects in center of an upper side of the movable piece 23.

Figure 6A:
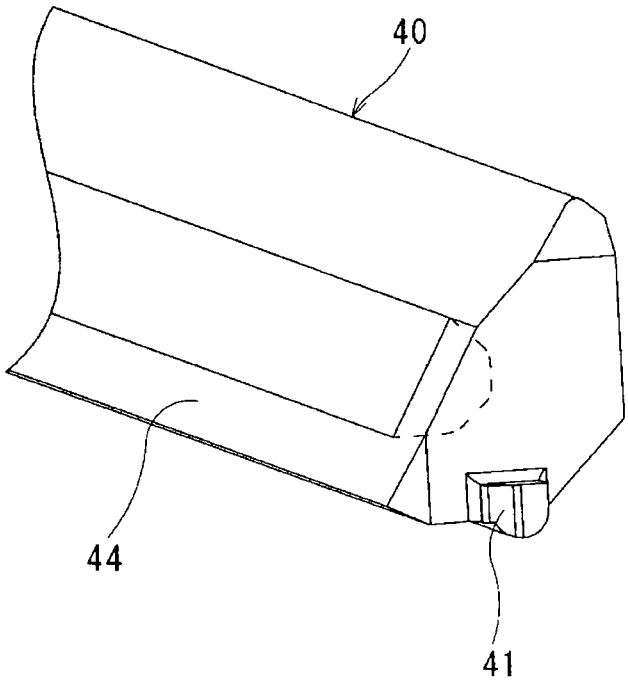
FIG. 6A is a partially enlarged perspective view of an operation lever shown in FIG. 3 seen from the front surface side.
Figure 6B:
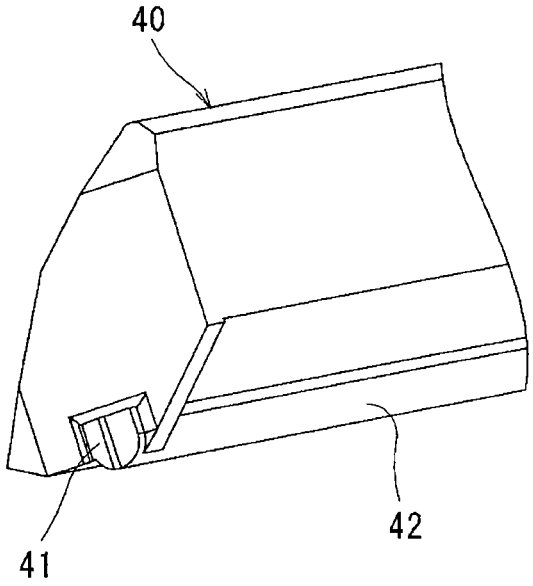
FIG. 6B is a partially enlarged perspective view of the operation lever of FIG. 6A seen from the rear surface side.

As shown in FIGS. 6A and 6B, the operation lever 40 has turning fitting portions 41, 41 projecting outward provided on the same axis center on both side end surfaces. A turning shaft portion 42 extending in the longitudinal direction so as to connect the pair of turning fitting portions 41, 41 and having an arc surface is formed.

Figure 8A:
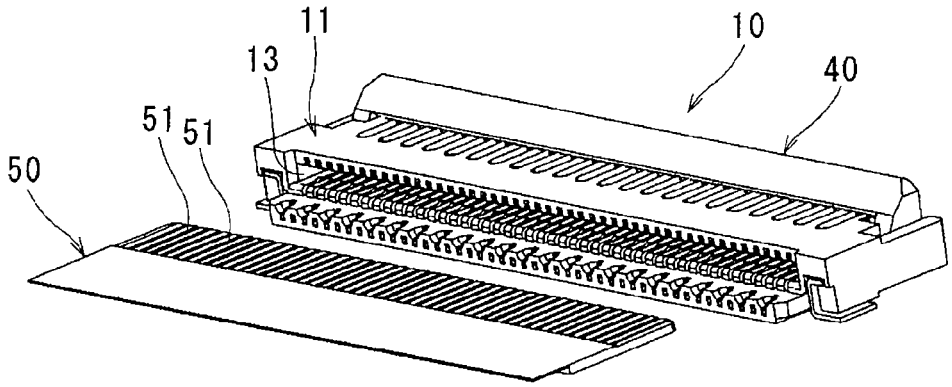
FIG. 8A is a perspective view of a state before a flexible print substrate is inserted into the connector.

It should be noted that the flexible print substrate 50 to be connected to the connector 10 according to the present embodiment has connection pads 51 which are print wired on an upper surface of a distal end edge thereof and arranged side by side (refer to FIG. 8A).

Figure 7A:
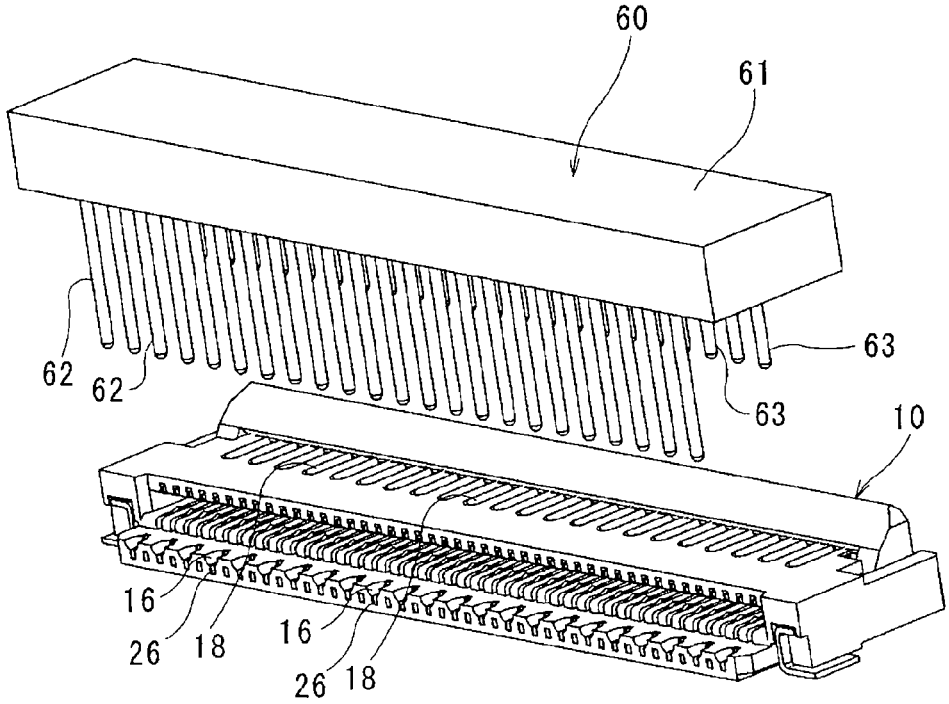
FIG. 7A is a perspective view showing a state before a continuity check probe is conducted to the connector.

A continuity check probe 60 for performing the continuity check for the connector 10 according to the present embodiment includes a platform 61, and first and second continuity check pins 62, 63 projecting from the platform 61 as shown in FIG. 7A. The first and second continuity check pins 62, 63 have a needle shape with distal ends thereof formed into a spherical surface, and the first continuity check pins 62 are longer than the second continuity check pins 63. The continuity check pins 62, 63 are arranged in the platform 61 in a zigzag manner in a front view.

The assembly method of the configuring parts described above will now be described.

Figure 2A:
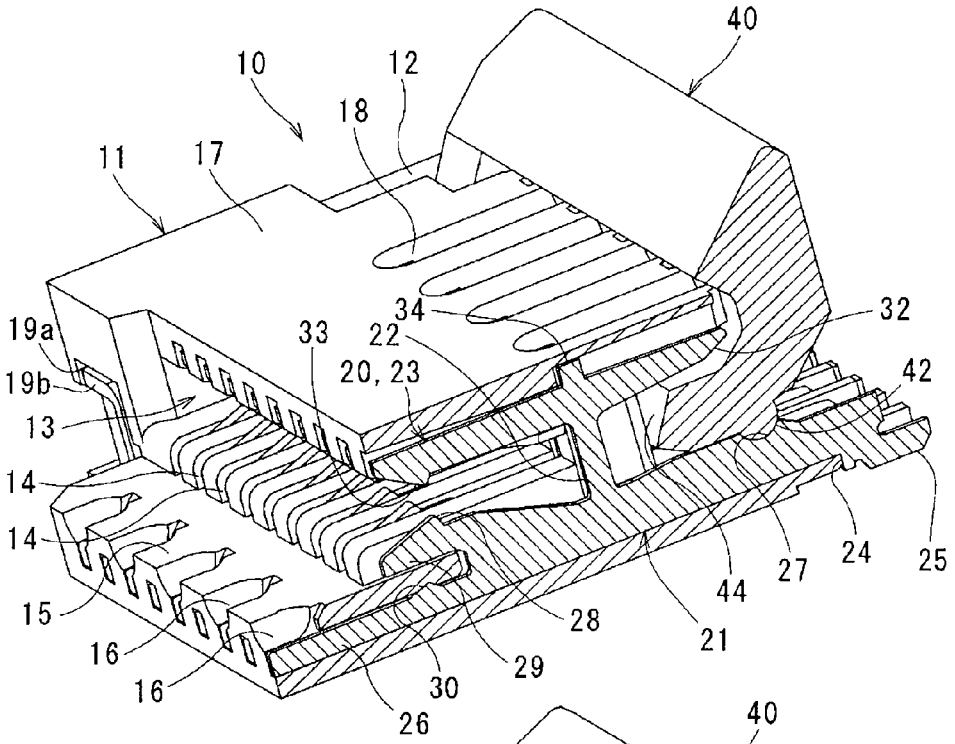
FIG. 2A is a sectional perspective view along an insertion hole in an odd number row from the left side of the connector shown in FIG. 1A.
Figure 2B:
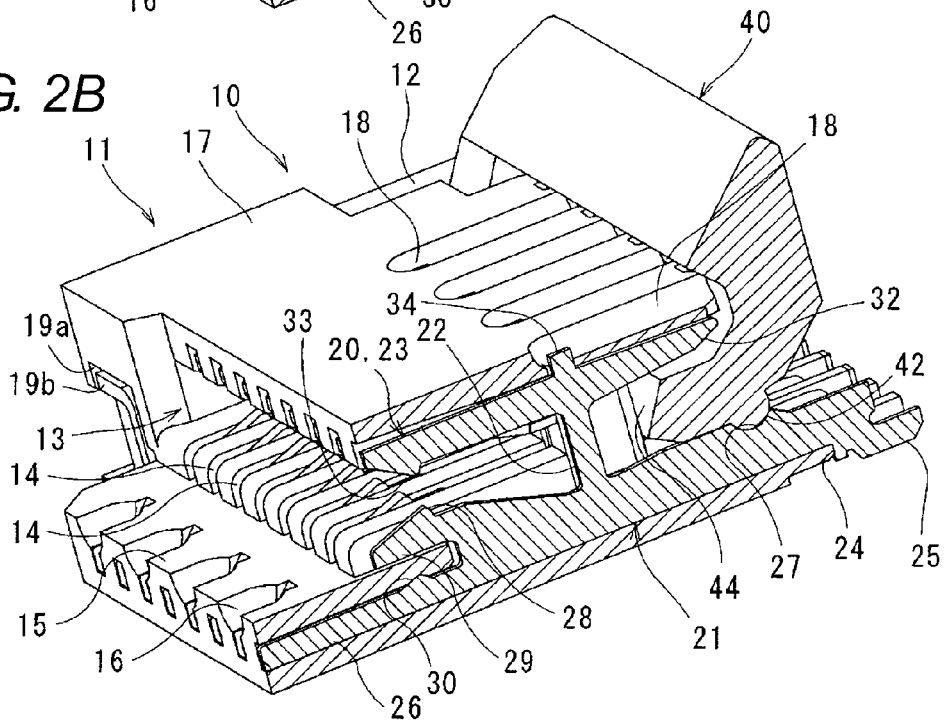
FIG. 2B is a sectional perspective view along an insertion hole in an even number row of FIG. 2A.

Firstly, as shown in FIG. 3, the continuity check extending portions 26 of the connection terminals 20 are inserted into the insertion holes 14 of the base 11 from the rear surface side. The fixing projections 30 provided in the connection terminals 20 are locked onto a ceiling surface of the lower portion 15 of the base 11, and the locking step portions 24 are locked onto an edge of the base 11, so that positioning is performed (refer to FIGS. 2A and 2B). At this time, as shown in FIG. 2A, the continuity check extending portions 26 of the connection terminals 20 arranged in odd number rows from the left side are exposed from the first receiving portions 16 of the base 11. Meanwhile, as shown in FIG. 2B, the continuity check projections 34 of the connection terminals 20 arranged in even number rows from the left side are exposed from the second receiving portions 18 of the base 11.

Next, the turning fitting portions 41 of the operation lever 40 are press fitted along the guide tapered surfaces 12*a* of the elastic arms 12 from the rear surface side of the base 11, so that the turning fitting portions 41 are fitted to the bearing recess portions 12*b*. Further, by positioning the turning shaft portion 42 in the turning receiving portions 27 of the connection terminals 20, the operation lever 40 is turnably supported with the turning shaft portion 42 as a center.

After the connector 10 is mounted into the exterior substrate (not shown), the continuity check is performed in order to confirm that the connection terminals 20 are conducted to the exterior substrate via the solder connection portions 25.

Specifically, as shown in FIG. 7A, the continuity check probe 60 is positioned in such a manner that the distal ends of the first continuity check pins 62 are abutted with the continuity check extending portions 26 via the first receiving portions 16, and the distal ends of the second continuity check pins 63 are abutted with the continuity check projections 34 via the second receiving portions 18.

Figure 7B:
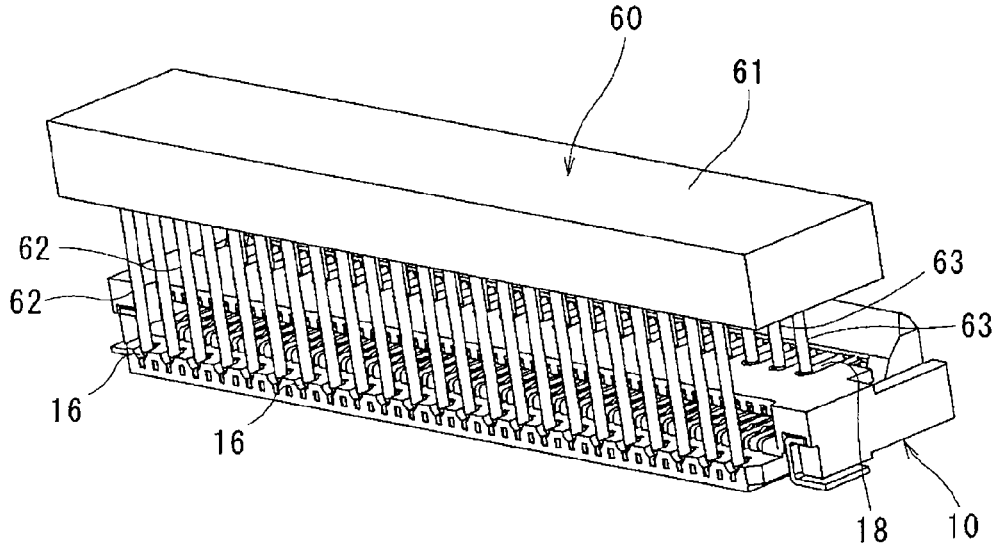
FIG. 7B is a perspective view showing a state that the continuity check probe is conducted to the connector.

As shown in FIG. 7B, by lowering the continuity check probe 60, the distal ends of the first continuity check pins 62 are fitted to ends of the first receiving portions 16, and the distal ends of the second continuity check pins 63 are fitted to ends of the second receiving portions 18. Therefore, the first continuity check pins 62 are abutted with the continuity check extending portions 26, and the second continuity check pins 63 are abutted with the continuity check projections 34, and thus, continuity is checked. Thereby, it can be confirmed that the connection terminals 20 are reliably conducted to the exterior substrate via the solder connection portions 25.

The method of connecting and fixing the flexible print substrate 50 to the connector 10 will be described based on FIGS. 8A to 10B.

Figure 8B:
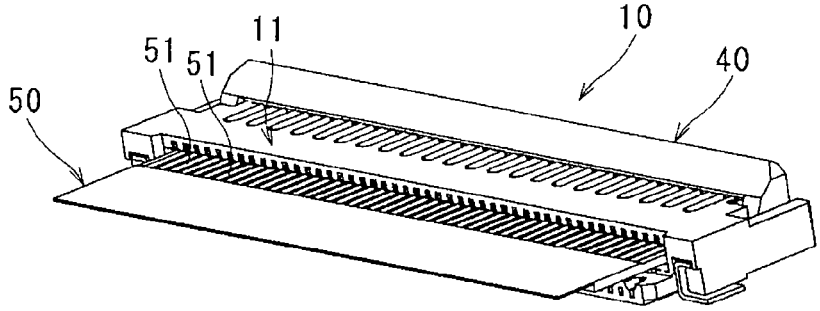
FIG. 8B is a perspective view of a state that the flexible print substrate is inserted into the connector.
Figure 8C:
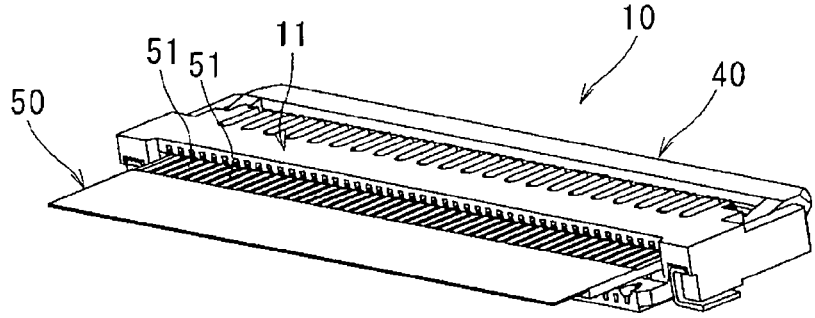
FIG. 8C is a perspective view of a state that the flexible print substrate is inserted into and fixed to the connector.
Figure 9A:
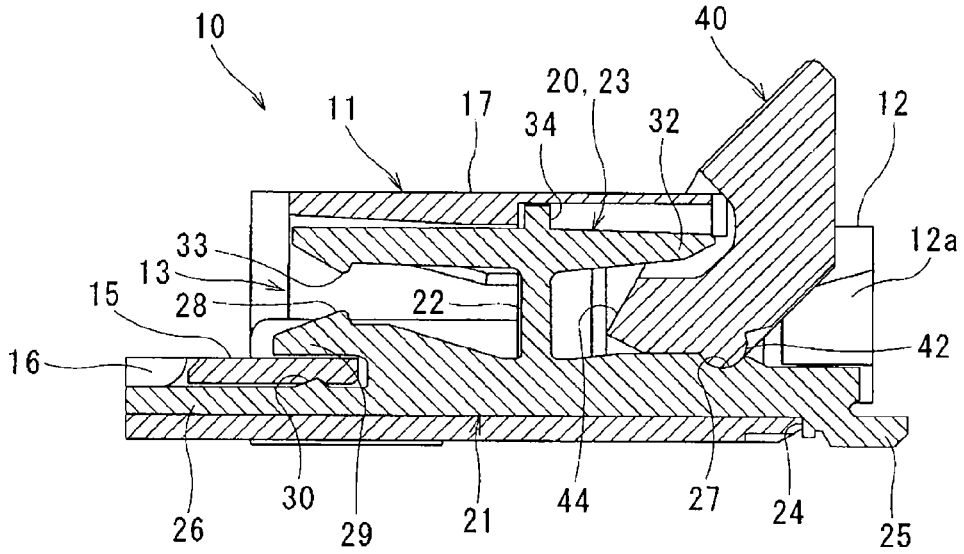
FIG. 9A is a sectional view along the insertion hole in the odd number row shown in FIG. 2A, showing a state before the flexible print substrate is inserted.
Figure 9B:
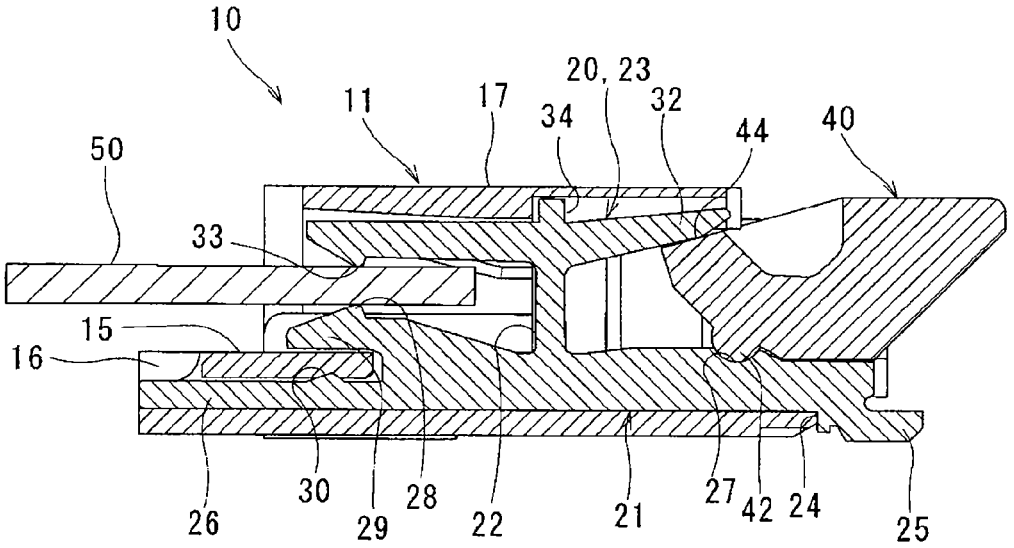
FIG. 9B is a sectional view showing a state that the flexible print substrate shown in FIG. 9A is inserted into and fixed to the connector.
Figure 10A:
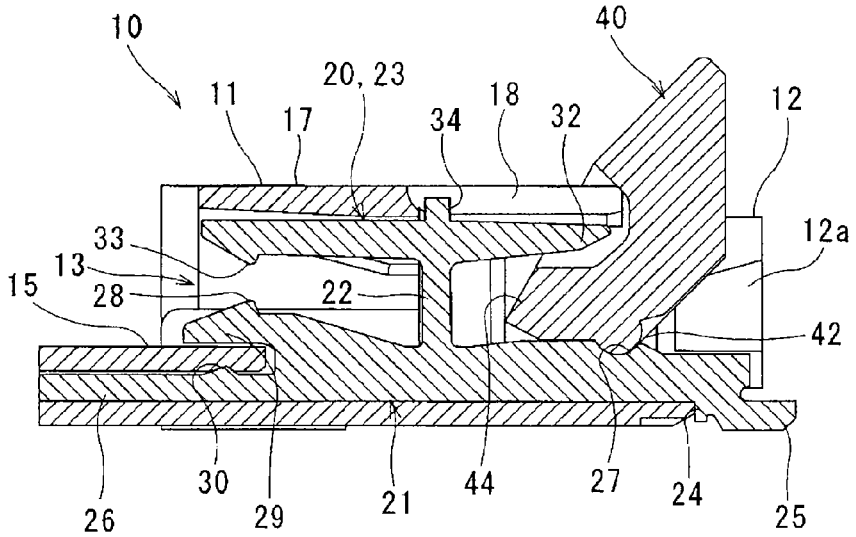
FIG. 10A is a sectional view along the insertion hole in the even number row shown in FIG. 2B, showing a state before the flexible print substrate is inserted.
Figure 10B:
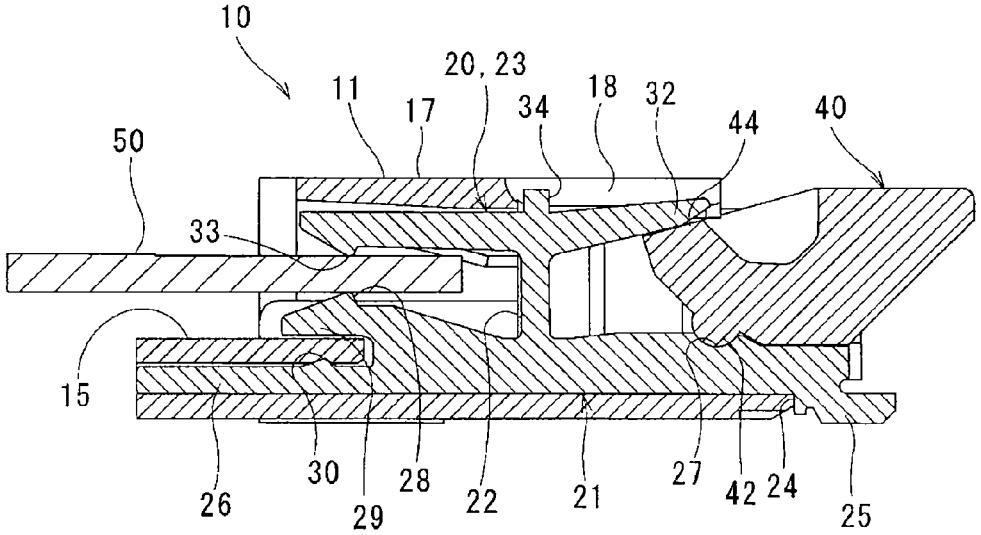
FIG. 10B is a sectional view showing a state that the flexible print substrate shown in FIG. 10A is inserted into and fixed to the connector.

In an unlock state of the operation lever 40 shown in FIGS. 9A and 10A, the flexible print substrate 50 is inserted from the opening 13 of the base 11 as shown in FIGS. 8A and 8B. When the operation lever 40 is turned and pushed down with the axis center of the turning shaft portion 42 as a center (refer to FIG. 8C), an operation surface 44 pushes up the operation receiving portions 32 of the connection terminals 20 so as to bring into a lock state as shown in FIGS. 9B and 10B. Therefore, the movable pieces 23 tilt with the coupling portions 22 as a supporting point, and the movable contacts 33 are pressed onto and conducted to the connection pads 51 of the flexible print substrate 50.

In the present embodiment, not only the movable contacts 33 push down and curve the flexible print substrate 50, but also the movable contacts 33 and the lower contacts 28 respectively bite into front and back surfaces of the flexible print substrate 50 and prevent slipping out, so that high contact reliability can be ensured.

Meanwhile, when detaching the flexible print substrate 50 from the connector 10, by turning the operation lever 40 in the opposite direction, the bending moment on the operation receiving portions 32 of the connection terminals 20 is cancelled, and a connection state of the movable contacts 33 to the flexible print substrate 50 is cancelled. After that, the flexible print substrate 50 is pulled out.

According to the present embodiment, the continuity check for the solder connection portions 25, 25 can be performed at the same time by at least one of the continuity check extending portions 26 and the continuity check projections 34. Thereby, there is no need for manufacturing two types of connection terminals corresponding to places in which the continuity check is performed. Thus, cost of a die for manufacturing the connection terminals can be reduced.

Since the continuity check extending portions 26 are provided on the opposite side of the solder connection portions 25 of the fixed pieces 21, a load of the first continuity check pins 62 is not applied to the solder connection portions 25 at the time of the continuity check. Therefore, even when soldering failure is generated between the solder connection portions 25 and the exterior substrate (not shown) at the time of performing the continuity check, a load is not applied to the solder connection portions 25. Thus, erroneous detection can be prevented.

Further, the continuity check projections 34 are provided on the same straight line as the coupling portions 22 having high support strength. Thus, even when a large load of the second continuity check pins 63 is applied at the time of the continuity check, deformation and breakage of the connection terminals 20 can be prevented. Since the continuity check projections 34 are displaced from the solder connection portions 25 in terms of depth of the base 11, a load at the time of the continuity check is not applied to the solder connection portions 25. Thus, the erroneous detection can be prevented.

Conventionally, for example, in order to arrange continuity check pins of a continuity check probe at 0.5 mm pitch so as to correspond to connection terminals arranged side by side at 0.5 mm pitch, there is a need for precise processing, and manufacturing cost of the continuity check probe is increased. Further, there is a problem that the continuity check pins are brought into erroneous contact with the adjacent connection terminals at the time of the continuity check.

However, in the present embodiment, by arranging the first and second continuity check pins 62, 63 in a zigzag manner, an interval between the first continuity check pin 62 and the second continuity check pin 63 adjacent to each other can be extended to 1.0 mm. Therefore, the continuity check probe 60 is easily manufactured, so that the manufacturing cost can be reduced. In addition, at the time of the continuity check, erroneous contact between the connection terminals 20 and the first continuity check pins 62 and the second continuity check pins 63 can be prevented. Since the continuity check is performed via the first receiving portions 16 and the second receiving portions 18, the continuity check between the connection terminals 20 and the exterior substrate can be performed without inserting the flexible print substrate 50 into the base 11.

Since the first receiving portions 16 are provided in the lower portion 15 of the base 11 and the second receiving portions 18 are provided in the upper portion 17 of the base 11, a height position is different between the first receiving portions 16 and the second receiving portions 18. Thereby, length can be differentiated between the first continuity check pins 62 and the second continuity check pins 63. Therefore, the first continuity check pins 62 are easily positioned in the first receiving portions 16, and the second continuity check pins 63 are easily positioned in the second receiving portions 18.

Since the distal ends of the first and second continuity check pins 62, 63 are respectively fitted to the ends of the first and second receiving portions 16, 18, displacement of the continuity check pins 62, 63 can be prevented at the time of performing the continuity check.

The present invention is not limited to the above embodiment but various modifications can be made.

Figure 11A:
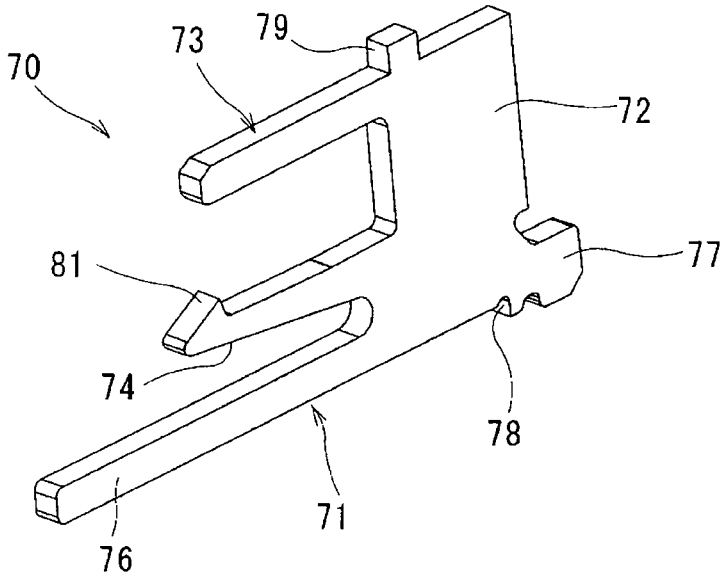
FIG. 11A is a perspective view showing a variant of the connection terminal of FIGS. 5A and 5B.
Figure 11B:
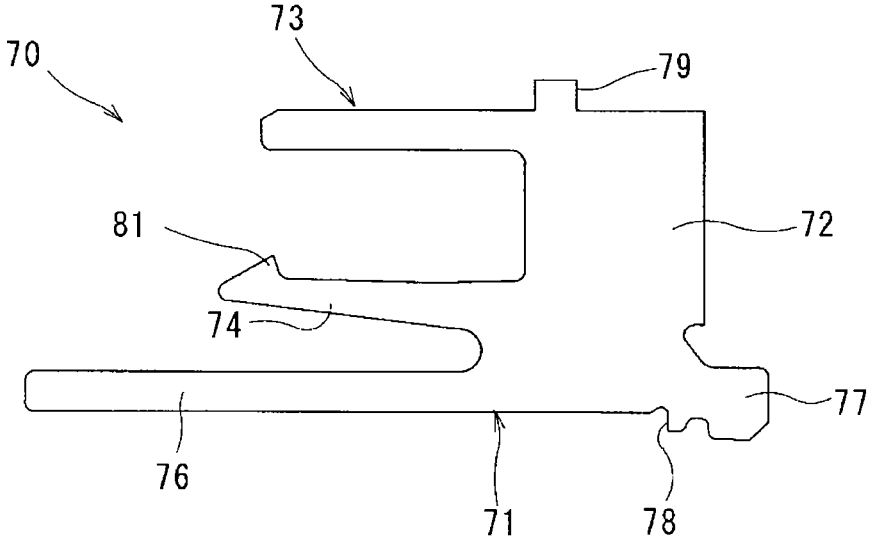
FIG. 11B is a side view of the connection terminal of FIG. 11A.

The connection terminals are not limited to a substantially H shape. For example, substantially U shape connection terminals 70 used for a sliding lock type connector shown in FIGS. 11A and 11B may be adopted. The connection terminal 70 includes a fixed piece 71 to be inserted into and fixed to the insertion hole 14 of the base 11, a coupling portion 72 arranged in a projecting manner at an upper side of the fixed piece 71, a support piece 73 extending in substantially parallel to the fixed piece 71 to one side from an upper end of the coupling portion 72, and a support piece 74 extending in substantially parallel to the fixed piece 71 to one side from the coupling portion 72 between the fixed piece 71 and the support piece 73.

The fixed piece 71 includes a continuity check extending portion 76 extending toward the front side, and a solder connection portion 77 to be connected to the exterior substrate by soldering or the like at a lower side of a rear surface side end thereof. A locking step portion 78 for locking onto the edge of the base 11 for positioning is formed on the front surface side of the solder connection portion 77. A continuity check projection 79 is provided at an upper side of the coupling portion 72. In a state that the connection terminal 70 is inserted into the insertion hole 14, the support piece 73 is abutted with the upper portion 17 so as to be supported by the base 11. The movable piece 74 includes a movable contact 81 projecting upward provided in a distal end thereof. The flexible print substrate 50 is inserted between the support pieces 73 and the movable pieces 74, and the connection pads 51 of the flexible print substrate 50 are conducted to the movable contacts 81 via an operation lever (not shown) having a wedge shape operation portion.

With the connection terminals 70 having the above configuration, the continuity check can be performed by at least one of the extending portions 76 for the continuity check and the projections 79 for the continuity check. Thus, manufacturing cost of the connection terminals 70 can be reduced.

Since the continuity check extending portions 76 are provided on the opposite side of the solder connection portions 77 of the fixed pieces 71, a load of the first continuity check pins 62 is not applied to the solder connection portions 77 at the time of the continuity check. Therefore, even when soldering failure is generated between the solder connection portions 77 and the exterior substrate (not shown) at the time of performing the continuity check, a load is not applied to the solder connection portions 77. Thus, the erroneous detection can be prevented.

Further, the continuity check projections 79 are provided at the upper sides of the coupling portions 72 having high support strength. Thus, even when a large load is applied at the time of the continuity check, deformation and breakage of the connection terminals 70 can be prevented.

A shape of the first and second receiving portions of the connector according to the present invention is not particularly limited as long as the continuity check extending portions and the continuity check projections of the connection terminals are exposed. For example, the first and second receiving portions may be circular or rectangular check holes from which the continuity check extending portions and the continuity check projections are exposed, the check holes passing through the base.

Although the connection terminals of the present invention are adopted in back lock type and sliding lock type connectors, the connection terminals may be adopted in a front lock type connector for example.

What is claimed is:

1. A connector connection terminal and a base of a connector, said connection terminal comprising:

a fixed piece configured to be fixed to the base;

a coupling portion extending upward from the fixed piece;

a moveable piece extending from the coupling portion in a direction facing the fixed piece;

an extending portion provided in an end of the fixed piece; and a projection provided at an upper side of the moveable piece;

wherein a plurality of said connector connection terminals are arranged side by side when said fixed piece of each of said plurality of connection terminals is fixed in the base; said base comprising:

first receiving portions, and second receiving portions, wherein said first and second receiving portions are arranged in a zigzag manner in the base, and the extending portions are exposed from the first receiving portions and the projections are exposed from the second receiving portions.

2. The connector connection terminal according to claim 1, wherein the projection extends on the same straight line as the coupling portion.

3. The connector connection terminal according to claim 1, wherein the movable piece extends to both sides from a free end of the coupling portion, and the projection is provided in the movable piece or the coupling portion.

4. The connector according to claim 1, wherein the first receiving portions are provided in a lower portion of the base, and the second receiving portions are provided in an upper portion of the base.

5. The connector according to claim 1, wherein said first receiving portions are configured to receive corresponding first continuity check pins; and said second receiving portions are configured to receive corresponding second continuity check pins.

6. The connector according to claim 1, wherein the movable pieces are operated and turned by an operation lever turnably assembled to the base, so as to nip flat conductive wire inserted between the movable pieces and the fixed pieces.

7. A connector continuity check method for performing a continuity check, wherein a connector connection terminal comprises a fixed piece to be fixed to a base of a connector, a coupling portion extending upward from the fixed piece, and a movable piece extending from the coupling portion in the direction facing the fixed piece, the connector connection terminal arranged side by side in the base further comprises an extending portion provided in an end of the fixed piece, and a projection provided at an upper side of the movable piece or the coupling portion, first receiving portions from which the extending portions are exposed, and second receiving portions from which the projections are exposed are arranged in a zigzag manner in the base in which the plurality of connector connection terminals is incorporated and arranged side by side, and the continuity check method comprises:

fitting first continuity check pins for performing the continuity check to ends of the first receiving portions and abutting the first continuity check pins with the extending portions; and fitting second continuity check pins for performing the continuity check to ends of the second receiving portions and abutting the second continuity check pins with the projections.

* * * * *